US006000291A

United States Patent [19]

Swift

[11] Patent Number: 6,000,291

[45] Date of Patent: Dec. 14, 1999

[54] STARTING ASSEMBLY FOR A LAWNMOWER ENGINE

[76] Inventor: William H. Swift, 9813 N. Highland Ave., Kansas City, Mo. 64155

[21] Appl. No.: 09/040,606

[22] Filed: Mar. 18, 1998

[51] Int. Cl.[6] ..... F02N 11/12

[52] U.S. Cl. ..... 74/6; 123/179.1; 123/179.26; 74/7 R; 192/42

[58] Field of Search ..... 123/179.1, 179.26, 123/185.5, 185.1; 74/6, 7 R; 56/10.5; 192/42, 46

[56] References Cited

U.S. PATENT DOCUMENTS

| | | | |
|---|---|---|---|
| 2,996,927 | 8/1961 | Rome | 123/179.26 |
| 3,051,155 | 8/1962 | Mehl et al. | 123/179.26 |
| 3,394,598 | 7/1968 | Hoch . | |
| 4,365,596 | 12/1982 | Bennett, Sr. . | |
| 4,531,482 | 7/1985 | Scheckel . | |
| 4,569,315 | 2/1986 | Bodnar . | |
| 5,174,166 | 12/1992 | Tyron et al. . | |
| 5,253,540 | 10/1993 | Sanders et al. . | |
| 5,540,540 | 7/1996 | Peterson | 414/563 |

*Primary Examiner*—Tamara L. Graysay
*Assistant Examiner*—William C Joyce
*Attorney, Agent, or Firm*—Kenneth L Tolar

[57] ABSTRACT

A starter assembly for assisting a user in starting a lawnmower engine includes a base component having two opposing vertical side walls, a vertical rear wall and planar horizontal upper and lower surfaces. A lawnmower may be suspended a predetermined distance above the upper surface by placing its wheels on a pair of opposed ramp members. Attached to a sidewall of the base component is an electric motor which rotatably drives a horizontal bar extending from the upper surface. The rotating bar has a pair of oppositely facing pivoting flaps for engaging a lawnmower blade. The electric motor is selectively activated with a lockable switch disposed on the exterior of the base component. Accordingly, when the electric motor is activated, the bar rotates and the flaps pivot to a vertical position to engage the lawnmower blade to rotate the blade at a speed sufficient to crank the engine.

13 Claims, 1 Drawing Sheet

STARTING ASSEMBLY FOR A LAWNMOWER ENGINE

BACKGROUND OF THE INVENTION

The present invention relates to an assembly for assisting a user in starting a recoil type lawnmower engine.

DESCRIPTION OF THE PRIOR ART

A push type lawnmower generally comprises a gasoline powered recoil type engine mounted on a housing which rotatably drives a cutting blade disposed therebelow. The recoil type engine is usually started with a pull cord having a handle at a distal end. Often, the cord must be pulled repeatedly before the engine starts, especially with older lawnmowers, which is tiresome and inconvenient. Although the elderly and similar physically impaired people are capable of mowing the grass with a push type lawnmower, these individuals may not have the physical capability to pull the cord repeatedly or with sufficient force to successfully start the engine. Accordingly, there is currently a need for a device that allows a user to start a lawnmower engine with minimal effort.

Numerous devices exist in the prior art for assisting a user in starting a recoil type lawnmower engine. For example, U.S. Pat. No. 5,253,540 issued to Sanders et al relates to a lawnmower starter aid comprising a pulley and handle combination attached to a vertical post. A cord is disposed about the pulleys, a first end of which is attached to the handle with the second end attached to the lawnmower starter cord. The lawnmower may then be started by pivoting the handle.

U.S. Pat. No. 5,174,166 issued to Tyron et al discloses a starter for a lawnmower comprising a vertical track securable to the lawnmower. The engine starter cord is disposed about a pulley with its end secured to a foot pedal. The foot pedal is vertically slidable within the track so that a user may step on the pedal to start the engine.

U.S. Pat. No. 4,569,315 issued to Bodnar relates to a power drill attachment for starting a lawnmower engine. The device includes a cap attachable to the engine crank shaft securable within a drill chuck.

U.S. Pat. No. 4,531,482 issued to Scheckel discloses a torque transmission device attachable to an engine crank shaft. The device includes a pair of mating cones that are rotatably driven by a drill.

U.S. Pat. No. 4,365,596 issued to Bennett, Sr. relates to an engine starting device comprising a case, a sliding shaft vertically disposed therein and a compression spring. The shaft has a socket on an end thereof for engaging the engine crankshaft. Downward pressure on the sliding shaft compresses the spring and engages the socket thereby starting the engine.

U.S. Pat. No. 3,394,598 issued to Hoch discloses a starting device for a lawnmower. A first embodiment relates to a socket assembly securable to a drill chuck. The second embodiment includes a supporting frame having a horizontal platform on which a lawnmower rests with a vertical member depending therefrom. A motor driven belt is attached to a pulley on the vertical member and to a second pulley mounted on the engine shaft.

The above described devices have several disadvantages. Although Hoch relates to a motor driven belt means, a switch or similar device for instantly starting or stopping the motor is not disclosed. In addition, the device in Hoch requires that a pulley be mounted to the engine crankshaft.

Each time an engine is to be started, the belt must be manually attached to the pulleys and removed therefrom once the engine is started. Such a practice is laborious and inconvenient. The drill attachments are difficult and cumbersome to remove from a crank shaft. In addition, these attachments cannot be conveniently used with all types of lawnmowers in which the crank shaft is not readily accessible. The present invention relates to a device having a motor driven bar extending from a support platform for selectively engaging the lawnmower blade to start the engine. When the motor is deactivated and the bar stops rotating, the bar no longer engages the blade allowing the cranked lawnmower to be easily removed from the platform.

SUMMARY OF THE INVENTION

The present invention relates to a device for assisting a user in starting a lawnmower. The device comprises a substantially rectangular base component having two vertical side walls and a vertical rear wall with spaced horizontal planar upper and lower surfaces therebetween. On the upper surface are a pair of opposed ramp members for receiving and supporting the lawnmower wheels to suspend the lawnmower a predetermined distance above the upper surface. Attached to a side wall is an electric motor for driving a belt and a pulley on the base component lower surface. The pulley has a shaft depending therefrom which extends through the upper surface having a horizontal bar at a distal end thereof. The bar has a pair of oppositely facing, hingedly engaging flaps each received within a recess on its top surface. Also attached to a sidewall of the base component is a vertical beam having a key actuated lock means for selectively activating a switch means which starts and stops the motor. Accordingly, a lawnmower may be placed on the upper surface of the housing with its blade immediately above the rectangular bar. When the electric motor is activated, the bar will rotate causing the flaps to pivot upwardly and engage the lawnmower blade, rotating it at a speed sufficient to start the engine. It is therefore an object of the present invention to provide an assembly that will start a lawnmower engine with the push of a button.

It is yet another object of the present invention to provide a lawnmower starter assembly which is easy to use and inexpensive to manufacture.

It is yet another object of the present invention to provide a lawnmower starter assembly that is selectively lockable with a key mechanism. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
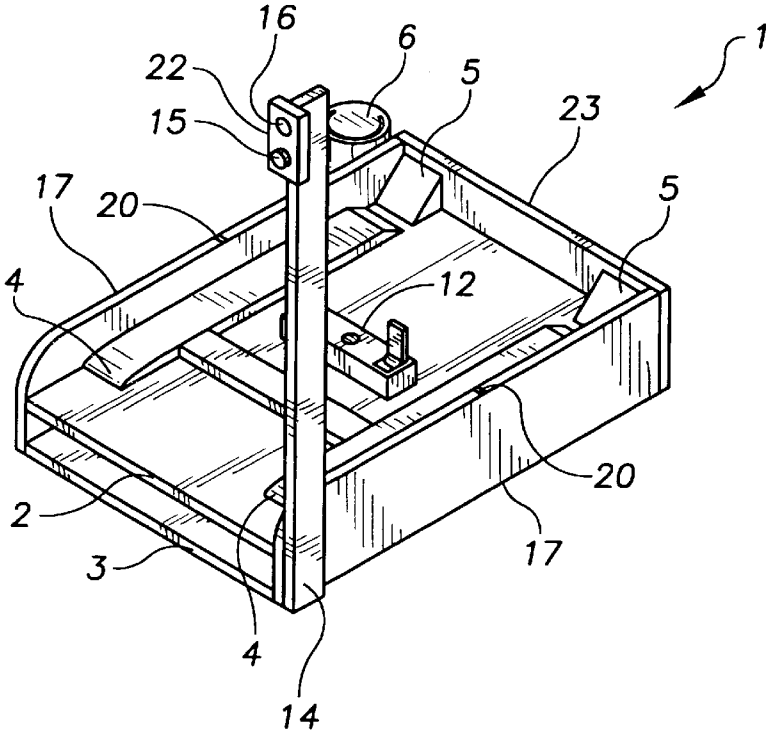
FIG. 1 depicts the inventive device.
Figure 2:
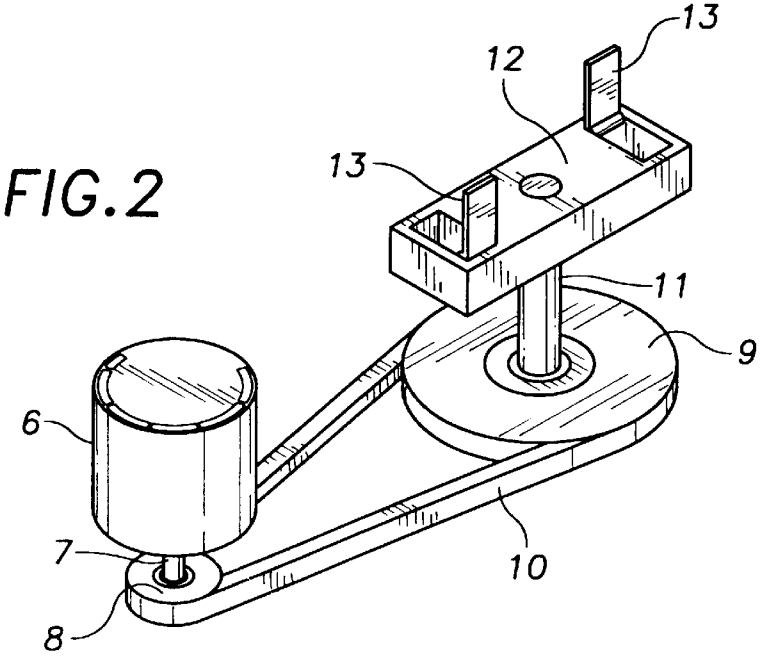
FIG. 2 depicts the electric motor and rotating bar assembly according to the present invention.

Referring now to FIGS. 1 and 2, the present invention relates to a starter assembly for a lawnmower engine. A lawnmower typically includes a housing with a pair of wheels on opposing sides thereof. The housing further includes an engine mounted on its upper surface which rotatably drives a cutting blade therebelow.

The present invention provides an assembly for assisting a user in starting the engine on a lawnmower described above. The device comprises a base component 1 having two opposing vertical side walls 17 and a vertical rear wall 23 with planar horizontal upper 2 and lower 3 surfaces perpendicularly disposed therebetween. On the upper surface of each opposing side walls is an alignment mark 20 to assist a user in properly orienting the cutting blade relative to the starting assembly.

Resting on the upper surface 2, each adjacent an opposing side wall, are a pair of opposed ramp members 4 for supporting the lawnmower's wheels to suspend the lawnmower cutting blade a predetermined distance above the upper surface. At an end of each ramp member is a wheel chock 5 for engaging a pair of opposing lawnmower wheels to prevent the lawnmower from shifting or rolling. The base component is dimensioned such that a lawnmower's front or rear wheels may be pivoted upwardly allowing the lawnmower to be easily rolled onto the upper surface. Alternatively, an additional ramp means may be used to assist the user in rolling the lawnmower onto the upper surface.

Attached to a base component side wall is a high speed electric motor 6 having a drive shaft 7 and a first pulley 8 attached thereto. A second pulley 9 is rotatably disposed on the lower surface and is driven with a belt 10 that encompasses both the first and second pulleys. Vertically extending from the second pulley 9 is a tubular shaft 11 which extends through the upper surface of the base component. Attached to the distal end of the tubular shaft 11 is a horizontal bar 12 having a substantially rectangular cross-sectional configuration for engaging a lawnmower blade. The bar 12 has a substantially planar horizontal top surface with a pair of recesses thereon each receiving an oppositely facing, hinged flap 13 therein which pivots to a vertical position upon rotation of the bar at a predetermined speed. The ramps members 4, the tubular shaft 11, the bar 12 and the flaps 13 are spaced and dimensioned such that the flaps engage the lawnmower blade suspended thereabove only when in a vertical position. When the flaps are in a substantially horizontal position, the bar will be in spaced relation with respect to the blade such that rotation of the blade is unimpeded. Preferably, each recess has a bolt, screw or similar stop means therein or protruding therefrom to prevent the flaps from pivoting to an absolutely horizontal position. By maintaining the flaps in an oblique position when the bar is motionless, the flaps will pivot upwardly more easily once the motor is started.

Attached to a side wall of the base component is a vertical beam 14 having a lock means 15 thereon. The lock means 15 relates to a switch actuated with a key which selectively activates a switch means 16 likewise disposed on the beam. The switch means 16 preferably relates to a momentary contact switch and is in communication with the electric motor for selectively delivering power thereto. Preferably, the internal components of the switch and lock means are received within an electrical box 22. Accordingly, the motor will operate as long as the switch is depressed and will cease operation whenever the switch is released.

To use the above described device, a lawnmower is placed onto the upper surface of the base component with its wheels resting on the opposing ramp members. Using the alignment marks, the user properly orients the cutting blade relative to the horizontal bar. The lawnmower engine controls are placed in the start position and the lock means is unlocked with its corresponding key. The momentary contact switch is depressed thereby starting the motor. The elongated bar will begin rotating causing the flaps to pivot upwardly thereby engaging the lawnmower blade. The bar will cause the blade to rotate with sufficient speed to crank the lawnmower engine. Once the engine is started, a user releases the switch means thereby deactivating the electric motor. As the RPM's of the horizontal bar decrease, the rotational speed of the blade will exceed that of the bar such that the blade will strike the hingedly engaging flaps on an opposing side thereof causing them to pivot back to a substantially horizontal but oblique position. The cranked lawnmower may then be removed from the base component and operated in a typical manner.

The above described device is not to be limited to the exact details described above. The base component is preferably constructed with wood, plywood or a similar material. The horizontal bar is preferably made from wood with a metallic L-shaped bracket attached to each end thereof and the hingedly engaging flaps are preferably constructed with a heavy gauge metal. The motor preferably relates to a 4600 RPM electric or a similar high speed motor. However, as will be readily apparent to those skilled in the art, the shape, size and materials of construction may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A starter assembly for a lawnmower comprising:

a base component having a planar upper surface for supporting a lawnmower thereon;

a horizontal bar extending from said planar upper surface of said base component having a pair of flaps thereon, said flaps pivotable between a vertical and a substantially horizontal position;

a motor attached to said base component in communication with said bar for selectively rotating said bar, said flaps in said substantially horizontal position when said bar is stationary, wherein a force produced by said bar when rotated at a predetermine speed pivots; said flaps to a vertical position for engaging and rotating a lawnmower cutting blade.

2. A starter assembly according to claim 1 wherein said base component further comprises a planar lower surface.

3. A starter assembly according to claim 2 further comprising:

a drive shaft attached to and rotatably driven by said motor, said shaft having two opposing ends with a first pulley mounted to one of said ends;

a second pulley disposed on said base component lower surface having a second shaft vertically extending therefrom, a distal end of which extends through said upper surface and is connected to said bar;

a belt means encompassing said first and second pulleys allowing said motor to drive said bar.

4. A starter assembly according to claim 3 further comprising a switch means in communication with said motor for selectively delivering power thereto.

5. A starter assembly according to claim 4 further comprising a lock means in communication with said switch means for selectively activating said switch means.

6. A starter assembly according to claim 5 further comprising a pair of spaced ramp members on the upper surface of said base component for supporting the wheels of a lawnmower to suspend a lawnmower cutting blade a predetermined distance above said upper surface.

7. A starter assembly according to claim 6 further comprising a pair of wheel chocks each adjacent one of said ramp members for abutting a pair of opposed wheels on a lawnmower.

8. A starter assembly according to claim 7 wherein said switch means comprises a momentary contact switch whereby said motor operates whenever said switch means is depressed and is deactivated when the switch means is released.

9. A starter assembly according to claim 8 further comprising a beam vertically attached to said base component on which said switch means and said lock means is mounted.

10. A starter assembly according to claim 9 wherein said lock means is selectively actuable with a key.

11. A starter assembly according to claim 10 wherein each of said flaps pivot in an opposite direction with respect to the horizontal bar.

12. A starter assembly according to claim 1 wherein said base component further includes a pair of opposing side walls each having an alignment mark thereon allowing a user to properly align a cutting blade with said bar.

13. A starter assembly according to claim 1 wherein said bar includes a pair of recesses each having one of said flaps received therein, said recesses further including a stop means received therein for preventing said flaps from pivoting to an absolute horizontal position.

* * * * *